United States Patent [19]

Thiem

[11] 4,213,543

[45] Jul. 22, 1980

[54] DISPENSER FOR DISPENSING THE CONTENTS OF COLLAPSIBLE PACKAGES

[76] Inventor: James E. Thiem, Route 2, P.O. Box 580, Brevard, N.C. 28712

[21] Appl. No.: 903,608

[22] Filed: May 8, 1978

[51] Int. Cl.[2] ..... B65D 35/28

[52] U.S. Cl. ..... 222/103; 222/105

[58] Field of Search ..... 222/45, 97, 103, 105, 222/491, 494; 401/152, 155, 158, 160, 163, 165

[56] References Cited

U.S. PATENT DOCUMENTS

| | | | |
|---|---|---|---|
| 1,518,821 | 12/1924 | Ross | 401/165 |
| 1,585,321 | 5/1926 | Wilson | 222/95 |
| 1,840,194 | 1/1932 | Hahn et al. | 222/491 |
| 2,515,440 | 8/1950 | Cicero | 222/103 |
| 2,850,212 | 9/1958 | Zabriskie | 222/103 |

FOREIGN PATENT DOCUMENTS

| | | | |
|---|---|---|---|
| 533660 | 9/1933 | Fed. Rep. of Germany | 222/103 |
| 775226 | 12/1934 | France | 401/165 |
| 358631 | 10/1931 | United Kingdom | 222/103 |

*Primary Examiner*—H. Grant Skaggs
*Attorney, Agent, or Firm*—Craig & Antonelli

[57] ABSTRACT

A dispensing apparatus for discharging the contents of collapsible packages includes a housing which is mountable to a supporting surface and in which the package, such as a toothpaste tube, is placed for the dispensing of its contents. The housing contains a pressure plate which is used to compress the package against a wall of the housing and includes a pair of pressure arms pivoted to a wall of the housing and engageable against spaced portions of the pressure plate, the pressure arms being linked together for joint movement under action of an operating member such as a lever arm. According to a preferred embodiment, pressure arms have a roller at their ends for reducing friction between the pressure arms and the pressure plate.

10 Claims, 4 Drawing Figures

DISPENSER FOR DISPENSING THE CONTENTS OF COLLAPSIBLE PACKAGES

BACKGROUND AND SUMMARY OF THE INVENTION

The present invention relates to a device for discharging the contents of various collapsible packages such as the tubes in which toothpaste, adhesive pastes, grease paints, and the like are commonly sold. More particularly, this invention relates to an improvement in the type of dispensing apparatus for dispensing the contents of collapsible packages which utilize a pressure plate for compressing the collapsible package to dispense the contents thereof.

Many types of dispensing apparatus are known in the prior art for dispensing the contents of collapsible packages, but the type in which a pressure plate is utilized to compress the package is believed to be most preferable since it lends itself to a simpler construction having fewer parts than other package discharging arrangements, such as apparatus using a travelling pair of nip rollers between which the package is compressed.

Representative of the prior art dispensing apparatus which utilize pressure plates are U.S. Pat. Nos. 1,320,275; 1,558,195; and 2,850,212. In the U.S. Pat. No. 1,320,275 a device for extruding paste from tubes is disclosed wherein a pressure plate is hinged to a frame so as to form a pair of jaws with a base plate between which the collapsible tube can be compressed. While this patent does disclose a simple device for dispensing the contents of a collapsible tube, it has several deficiencies inherent in its manner of construction. Firstly, since the pressure plate is hinged to form a pair of jaws, the device can only be utilized with the type of tapered tube conventionally used with toothpaste and is not suitable for use with blunt ended packages. Furthermore, the arrangement of U.S. Pat. No. 1,320,275 merely utilizes a single pressure applying member for causing displacement of the pressure plate such that uniform pressure cannot be applied and difficulties in discharging the total contents of the package result due to deflections of the hinged pressure plate that can occur in areas at which no actuating pressure is applied.

In U.S. Pat. No. 1,558,195, the above-noted disadvantage which results from the pivotal mounting of a pressure plate is avoided, but since the pressure plate disclosed therein is arcuate in shape and since pressure is applied for compressing the package only at a single central point, all of the contents of the tube cannot be discharged since the arcuate contour of the pressure plate prevents totaly compression of the package against an oppositely facing wall of the housing, while the single mounting point prevents uniform pressure application and enables a swinging of the pressure plate with the resultant effect that a portion of the contents of the package can become trapped in the bottom half thereof.

In U.S. Pat. No. 2,850,212 a fluid dispensing apparatus is shown having a jaw arrangement similar to that of U.S. Pat. No. 1,558,195 wherein the pressure applying arm is provided with a roller for engaging the rear of the pressure plate and the pressure arm is angled rearwardly so that pressure is applied to the bottom half of the package, thereby avoiding the previously noted problem with respect to part of the contents becoming trapped in the bottom of the bag. However, disadvantages still persist in the arrangement disclosed in U.S. Pat. No. 2,850,212 since but a single pressure applying arm is utilized to compress the package against the wall of the housing, such that uniform pressure cannot be applied to the package and the forward end of the pressure plate is free to swing upwardly preventing the entire contents to be forced from the package, no force being directly appliable to the part of the pressure plate contacting the forward discharge end of the package.

In addition to the above-noted disadvantages, the prior art dispensing arrangements had limited flexibility with regard to the number of sizes of packages that could be used in a particular device due to the fact that but a single pressure arm was provided.

Accordingly, it is an object of the present invention to provide a dispensing apparatus for discharging the contents of collapsible packages which is of a simple construction having a minimum of working parts.

It is a further object of the working invention to provide an improvement is dispensers for collapsible packages of the type utilizing a pressure plate for compressing the package against a wall member having the capability of accepting packages of varying sizes and shapes.

It is still another object of the present invention to provide a dispensing apparatus that dispenses the contents of collapsible packages through the use of a pressure plate which compresses the package against a wall member which will ensure that complete discharge of the contents of the package will be obtained.

These and other objects of the present invention are obtained in a preferred embodiment of the present invention through the provision of a housing which is mountable to a supporting surface within which the collapsible package can be held with its discharge outlet extending therefrom. Additionally, a pressure plate is positioned within the housing extending longitudinally therein so that it can be urged towards a wall of the housing to collapse the package between the pressure plate and the wall under action of an actuating means. This actuating means includes a pair of pressure arms which are pivotally connected at a first end to a wall of the housing and are engageable at their opposite end to spaced portions of the pressure plate so that displacement of an operating means will pivotally swing the pressure arms along the pressure plate, causing displacement of the pressure plate towards the wall of the housing with a resultant collapsing of the package and a dispensing of its contents.

Other features of the preferred arrangement advantageously provide rollers on the pressure plate contacting ends of the pressure arms so as to reduce friction between the pressure arms and the pressure plate, and a cap of flexible material having a dispensing slit at one end is provided for mounting upon the discharge outlet of the collapsible package for preventing leakage and enabling a desired uniform distribution of the dispensed material.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
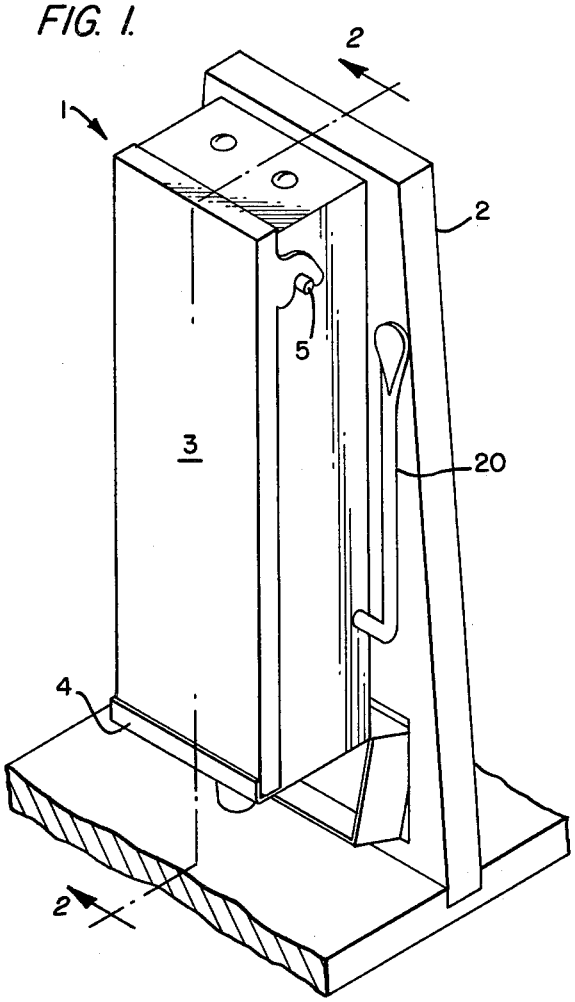
FIG. 1 is a front perspective view of a dispensing apparatus according to the present invention shown mounted upon a stand.

As shown in FIG. 1, the dispensing apparatus according to the present invention has a housing 1 which is mountable to a supporting surface such as the stand 2, though it need not be so mounted, wall mounting, hand held, and free standing use being equally possible. As shown, the housing 1 has a door 3 which can be removed by lifting it out of the flange 4 and off of the prongs 5 (only one prong being shown) so as to enable insertion of a package to be dispensed and removal of the empty package.

Figure 2:
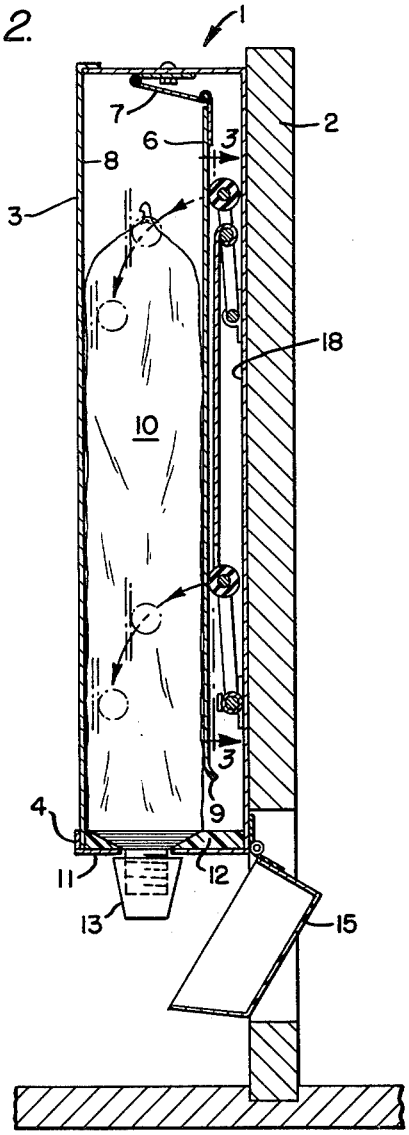
FIG. 2 is a sectional view taken along line II—II of FIG. 1.
Figure 3:
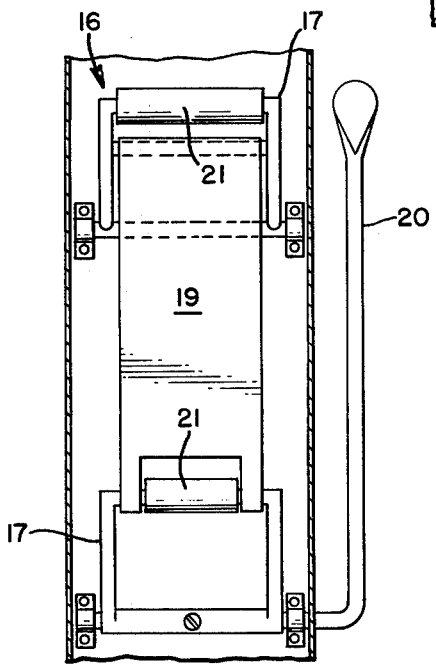
FIG. 3 is a partial sectional view taken along line III—III of FIG. 2 illustrating the pressure plate actuating means.

As is shown in FIG. 2, a pressure plate 6 is suspended from one end of the housing 1 by way of a double hinge 7. This double hinge 7 is located at the innermost end of the housing 1 and enables the pressure plate to be swung in an arc downwardly and outwardly towards the wall of the housing formed by the door 3. In this manner, the pressure plate defines one side of a collapsible package receiving chamber within the housing which can be reduced in size as the pressure plate cooperates with the inside wall 8 to collapse the package and dispense its contents. Furthermore, since the pressure plate 6 is caused to move outwardly and downwardly with respect to the door 3, the lower end thereof is provided with a curved portion 9 extending away from the package so as to prevent accidental piercing thereof.

In order to retain the collapsible package 10 within the housing 1, yet still enable a discharging of its contents, the lower wall 11 of the housing 1 is provided with an opening through which the discharge outlet of the package 10 is extendable. In order to provide a stable and secure positioning of the package within the opening of the housing 1, the lower end of the housing is provided with a contour plate 12 having an opening through which the discharge outlet of the package 10 extends and which has a surface conforming to the outward end contour of the collapsable tube. In the illustrated embodiment, this contoured surface is frusto-conical so as to mate with the standard frusto-conical discharge end of a toothpaste tube. However, this plate may be removed as it merely rests upon the lower wall 11 so as to enable substitution of a contour plate suitable for use with other shape packages.

Figure 4:
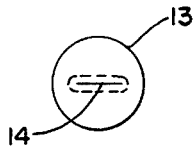
FIG. 4 shows an end view of closure cap forming part of the preferred embodiment.

In order to prevent the package 10 from lifting itself upwardly out of the plate 12, and so as to prevent leakage of more fluent materials when the package 10 is held within the housing 1 in a vertical orientation such as is shown in the drawings, the illustrated embodiment shows the use of a cap of flexible material 13 having a dispensing slit 14 at one end, and which is mounted upon the discharge outlet of the collapsible package 10. This cap can be formed of any resilient material such as neoprene. By constructing the cap of such a resiliently deformable material, the cap can be deformed, opening the dispensing slit 14, when pressure is applied by the pressure plate 6 to the collapsible package 10, thereby permitting a dispensing of the contents of the package, and then the cap can return to a shape closing the dispensing slit when the pressure is discontinued, thereby preventing leakage of the package contents. The particular cap shown, which is designed for the tubular outlet of a package such as is conventionally utilized for toothpaste is advantageously configured so as to be trapezoidal in vertical cross-section and tapers from a round inlet end overlying the outlet of the package toward a ridge-like shape at the discharge slit 14 as such a shape enables a secure fitting of the cap 13 to the outlet of the package and a smooth uniform application of a band of material as is preferable when, for example, applying toothpaste to a toothbrush or glue to a seam to be sealed. In this regard, the deformed open configuration is illustrated in dash lines in FIG. 4.

When the dispenser is to be utilized with packages for dispensing products, such as toothpaste, with respect to which a sanitary condition must be maintained, the use of a protective door mounted to the housing, as shown in the drawings, enables a sanitary environment to be maintained without obstructing access to the discharge slit when material is to be dispensed.

As noted previously, the pressure plate 6 is mounted so as to be displaceable towards wall surface 8 of the housing 1 for the purpose of collapsing the package 10. To obtain this displacement of the pressure plate 6, an actuating arrangement 16 is provided which includes two pressure arms 17 which are pivotally mounted to the rear wall 18 of the housing 1. To ensure coordinated movement of the two pressure arms 17, a link 19 is provided formed of sheet metal folded around cross struts of the pressure arms 17 so as to enable relative rotation therebetween. In this manner, when the operating lever arm 20, which is formed integrally with the pivot arm of one of the pressure arms 17, is swung, a corresponding swinging of the linked pressure arms 17 is achieved, thereby causing the pressure arms to move along the rear of pressure plate 6 displacing it in the direction of the arrows shown in FIG. 2 and as illustrated by the dot dash outline representations.

It has also been found to be advantageous to provide a roller 21 on the end of each of the pressure arms which contact the back of the pressure plate 6. In this manner, friction between the pressure arms 17 and the pressure plate 6 can be reduced, thereby reducing wear due to the engagement therebetween.

As will now be apparent, the dispensing apparatus according to the present invention is usable by removing the cap from the collapsible package and substituting the resilient cap 13, removing the door 3 and then inserting the package into the housing 1 with its outlet end bearing the cap 13 extending through the hole in the contour plate 12 and the housing wall 11. By then turning the lever 20, any desired amount of fluent material can be forced out of the package for use in whatever manner desired. Furthermore, since the pressure arms 17 enage the pressure plate 6 both at the upper and lower ends thereof, and since the pressure plate moves downwardly (i.e., the entire pressure plate moves axially toward outlet wall 11) as well as outwardly, a uniform pressure is applied to the package 10, regardless of its size or shape, causing it to be completely collapsed in a manner which precludes the entrapment of any appreciable amount of the package's contents, thereby minimizing waste.

Accordingly, it is plain that the present invention is a dispensing apparatus for collapsible packages which is inexpensive to make and can be manufactured as an attractive fixture when it is to be utilized in a displayed manner, such as when used in a bathroom for dispensing toothpaste, and since it has only three working parts, the control arm 20, the pressure arms 17, and the double-hinged pressure plate 6, it is virtually trouble-free. Furthermore, the apparatus can be manufactured of brass, stainless steel, crome or plastic.

Additionally, the dispensing apparatus according to the present invention is simple to use and easy to maintain in a sanitary condition, when such is important, since to clean the apparatus when changing a package, only the cap 13 and perhaps the bottom protective door 15 need any attention.

Still further it is clear that due to the construction of the dispenser apparatus of the present application, various sized packages can be utilized in any particular dispenser and the specific illustrated embodiment can be easily modified to be adapted to unconventionally configured packages or larger packages than the toothpaste tube shown as an example of the package 10.

While I have shown and described one embodiment in accordance with the present invention, it is understood that the same is not limited thereto, but is susceptible of numerous changes and modifications as known to those skilled in the art and I therefore do not wish to be limited to the details shown and described herein but intend to cover all such changes and modifications as are encompassed by the scope of the appended claims.

I claim:

1. A dispensing apparatus for dispensing the contents of collapsible packages comprising:

(a) a housing mountable to a supporting surface, said housing having an outlet at one end through which a collapsible package discharge outlet is extendable;

(b) a pressure plate extending longitudinally within said housing and defining one side of a collapsible package receiving chamber, and cooperating with a first opposing wall of said housing to dispense the contents of said package, said pressure plate extending from adjacent said one end to adjacent another innermost end of the housing opposite said one end and mounted for movement in an arc toward said opposing wall in such a manner that the entire pressure plate moves axially toward said outlet; and (c) actuating means for shifting said pressure plate toward said first wall of said housing to collapse said package and dispense the contents thereof, said actuating means including a pair of pressure arms, each pressure arm being pivotally connected at a first end to a second wall of the housing and engageable at a second end with spaced portions of said pressure plate, link means interconnecting said pressure arms for joint movement between a first position with the section end of one pressure arm adjacent said innermost end of said housing and the second end of the other pressure arm in a central zone of said housing located intermediate said one end and said innermost end, and a second position with said one pressure arm displaced to said central zone and said other pressure arm displaced away from said central zone toward said outlet end of the housing, and operating means for pivotally swinging said pressure arms along said pressure plate for causing displacement of said pressure plate toward said first wall, whereby said package is collapsed between said first wall and said pressure plate and the contents thereof is dispensed.

2. A dispensing apparatus according to claim 1, wherein each of said pressure arms include a roller means at its second end for reducing friction between said pressure arms and said pressure plate, thereby reducing wear due to engagement of said pressure arms along said pressure plate.

3. A dispensing apparatus according to claims 1 or 2, wherein said operating means is a lever arm connected at one end to the first end of one of the pressure arms and having a second end extending outside the housing for manipulation by a user.

4. A dispensing apparatus according to claims 1 or 2, wherein a cap of flexible material having a dispensing slit at one end is provided for mounting upon the discharge outlet of the collapsible package, said cap being constructed so as to resiliently deform opening said dispensing slit when pressure is applied by the actuating means to the collapsible package to permit dispensing of the contents of the package, and to return to a shape closing said dispensing slit when said pressure is discontinued for preventing leakage of said contents.

5. A dispensing apparatus according to claim 4, wherein said cap is formed of neoprene.

6. A dispensing apparatus according to claim 4, wherein said cap is trapezoidal in vertical cross-section and tapers from a round inlet end toward a ridge-like shape at the discharge slit.

7. A dispenser according to claim 4, wherein said housing is provided with a protective door which is mounted to be displaceable from a first position overlying the cap and a second position providing unobstructed access to the discharge slit.

8. A dispenser according to claim 1, wherein a removeable contour plate is provided overlying the outlet end of the housing, said contour plate having an opening through which the discharge outlet of the package is extendible and a package supporting surface conforming to the outlet end contour of the collapsible tube.

9. A dispensing apparatus according to claim 1, wherein the end of said pressure plate that is adjacent said outlet is provided with a package compressing surface that is curved away from a package contained in said receiving chamber so as to prevent piercing thereof by said end of said plate.

10. A dispensing apparatus according to claim 9, wherein said mounting of said pressure plate is formed by a double hinge one end of which is connected to said housing end opposite said outlet and the other end of which is secured to the end of the pressure plate located adjacent thereto.

* * * * *